United States Patent [19]

Coenen et al.

[11] Patent Number: 4,485,003

[45] Date of Patent: Nov. 27, 1984

[54] SUPERCRITICAL EXTRACTION AND SIMULTANEOUS CATALYTIC HYDROGENATION OF COAL

[75] Inventors: Hubert Coenen; Rainer Hagen; Ernst Kriegel, all of Essen, Fed. Rep. of Germany

[73] Assignee: Fried. Krupp Gesellschaft mit beschränkter Haftung, Essen, Fed. Rep. of Germany

[21] Appl. No.: 402,933

[22] Filed: Jul. 29, 1982

[30] Foreign Application Priority Data

Aug. 25, 1981 [DE] Fed. Rep. of Germany ..... 3133562

[51] Int. Cl.[3] ..... C10G 1/06

[52] U.S. Cl. ..... 208/10; 208/8 LE

[58] Field of Search ..... 208/8 R, 10, 8 LE

[56] References Cited

U.S. PATENT DOCUMENTS

| | | | |
|---|---|---|---|
| 3,488,280 | 1/1970 | Schulman | 208/10 |
| 3,505,204 | 4/1970 | Hoffman | 208/10 |
| 3,660,269 | 5/1972 | McCauley | 208/8 |
| 3,745,108 | 7/1973 | Schuman | 208/10 |
| 3,850,738 | 11/1974 | Stewart, Jr. et al. | 208/8 R |
| 4,019,975 | 4/1977 | Uruqhart | 208/10 |
| 4,056,460 | 11/1977 | Malek | 208/8 LE |
| 4,222,849 | 9/1980 | Shimizu | 208/8 LE |
| 4,237,101 | 12/1980 | Willard, Sr. | 208/8 LE |
| 4,298,450 | 11/1981 | Ross et al. | 208/10 |
| 4,338,184 | 7/1982 | Maa et al. | 208/8 LE |

*Primary Examiner*—Delbert E. Gantz
*Assistant Examiner*—Lance Johnson
*Attorney, Agent, or Firm*—Spencer & Frank

[57] ABSTRACT

A process for producing liquid hydrocarbons from coal comprises treating comminuted coal at 380° to 600° C. and 260 to 450 bar with water in a high pressure reactor to form a charged supercritical gas phase and a coal residue. Simultaneously with the water treatment, hydrogenation with hydrogen takes place in the presence of a catalyst. The catalyst is selected from the group consisting of NaOH, KOH, $Na_4SiO_4$, $NaBO_4$, or $KOB_2$. Then, the gas phase is divided into several fractions by lowering its pressure and temperature. Energy and/or gas is generated from the coal residue.

15 Claims, 1 Drawing Figure

SUPERCRITICAL EXTRACTION AND SIMULTANEOUS CATALYTIC HYDROGENATION OF COAL

BACKGROUND OF THE PRESENT INVENTION

The present invention relates to a method for producing liquid hydrocarbons from coal. Liquid hydrocarbons that can be produced according to this method are, inter alia, alkanes, cycloalkanes and aromatics which have a boiling point of 20° to about 350° C. and whose molecules contain 5 to about 30 carbon atoms. Such liquid hydrocarbons are processed primarily into fuels and lubricants and are used as heating oils and chemical raw materials.

It is known that hydrocarbons can be obtained from coal by catalytic hydrogenation. According to the Bergius process, finely ground coal is mixed into a dough with heavy oil or tar and with a molybdenum containing catalyst. The resulting mixture is then hydrogenated with hydrogen at 200 to 300 atmospheres gauge and at 450° to 500° C. The reaction mixture obtained after the hydrogenation is separated by distillation and furnishes gasoline, gas oil and a residue which is again mixed with coal dust and returned to the hydrogenation process. The hydrocarbons produced according to the Bergius process include primarily alkanes and cycloalkanes. See H. Beyer, "Lehrbuch der organischen Chemie", in translation, Organic Chemistry Textbook, published by S. Hirzel Verlag, Leipzig, 1962, pages 63 to 64.

SUMMARY OF THE PRESENT INVENTION

It is an object of the present invention to provide a method for obtaining liquid hydrocarbons from coal.

It is a further object of the present invention to provide such a process which results in a high yield, operates economically and safely, can be operated with coal of various origins and furnishes only a small quantity of waste products.

Additional objects and advantages of the present invention will be set forth in part in the description which follows and in part will be obvious from the description or can be learned by practice of the invention. The objects and advantages are achieved by means of the processes, instrumentalities and combinations particularly pointed out in the appended claims.

To achieve the foregoing objects and in accordance with its purpose, the present invention provides a process for producing liquid hydrocarbons from coal, comprising: treating comminuted coal which has a particle size of 1$\mu$ to 5 mm with water at 380° to 600° C. and 260 to 450 bar for 10 to 120 minutes in an amount of from 100 to 1000 percent by weight with respect to the coal and simultaneously with the treatment with the water, adding hydrogen and providing a catalyst to form a charged hydrogenated supercritical gas phase containing hydrogenated organic compounds and a coal residue the hydrogen being present in an amount of 2 to 10 percent by weight with respect to the coal, the catalyst being NaOH, KOH, $Na_4SiO_4$, $KBO_2$ or $NaBO_2$ and being dissolved in water in a quantity of from 0.001 to 0.5 weight percent with respect to the water; and separating the hydrogenated supercritical gas phase into its components in a plurality of fractions by lowering its pressure and its temperature.

Preferably, the coal residue is used to generate energy and/or gas.

It is understood that the fact that the water treatment and the hydrogenation take place at the same pressure and at the same temperature, of course, includes the possibility that certain system-caused changes in pressure and temperature may occur.

In the present invention, the hydrogenation is effected simultaneously with the water treatment of the comminuted coal. To effect a simultaneous water treatment and hydrogenation, the hydrogenation is performed in the same reactor where the water treatment is occurring.

It is to be understood that both the foregoing general description and the following detailed description are exemplary, but are not restrictive of the invention.

BRIEF DESCRIPTION OF THE DRAWINGS

The accompanying drawings illustrate examples of presently preferred embodiments of the invention and, together with the description, serve to explain the principles of the invention.

Of the drawings:

Figure 1:
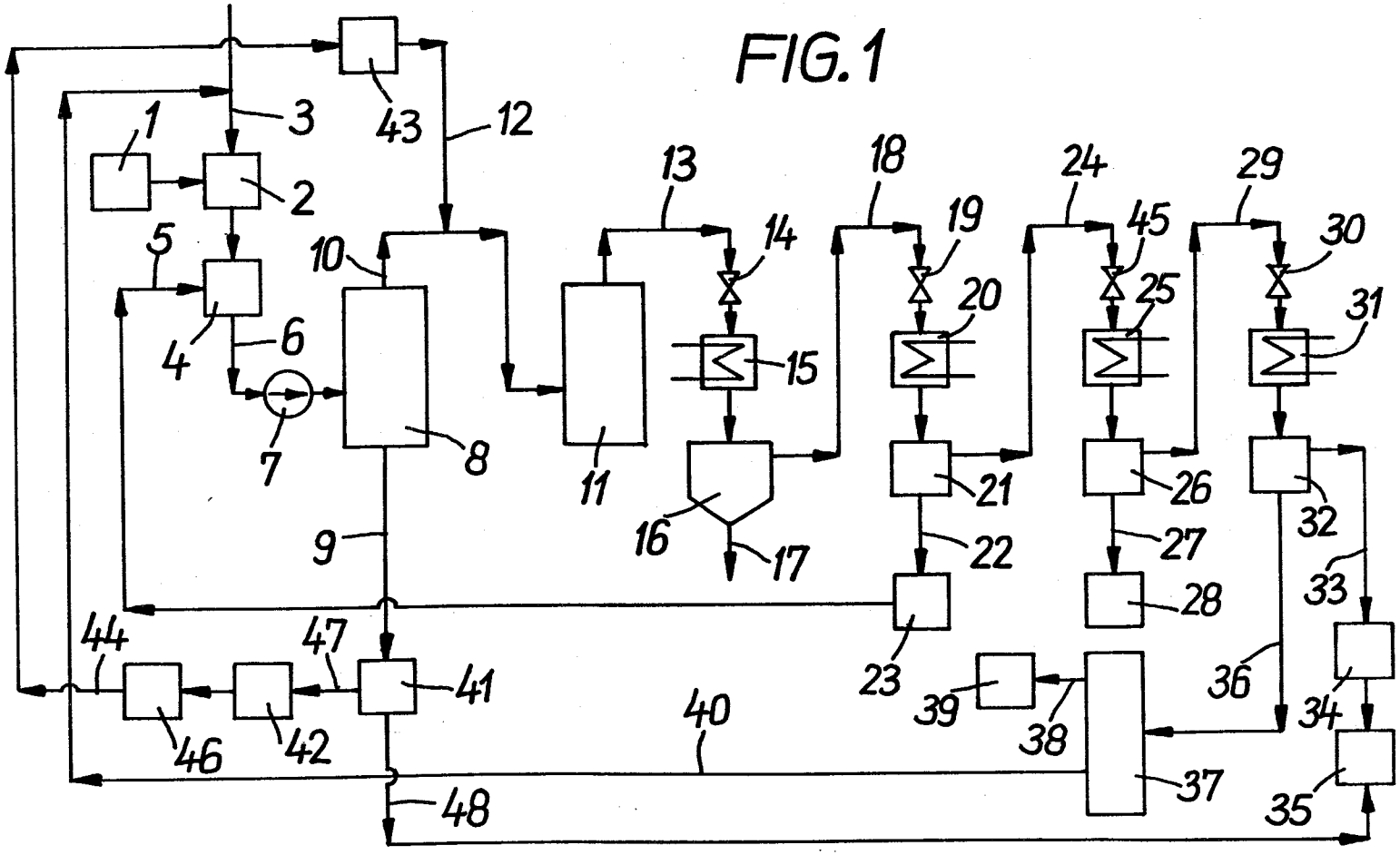

The sole FIGURE is a schematic drawing showing an apparatus for performing the present invention wherein the water treatment and hydrogenation are effected simultaneously, and inorganic compounds and water contained in the hydrogenated gas phase are simultaneously separated from the gas phase.

DETAILED DESCRIPTION OF THE INVENTION

In the practice of the present invention, up to 50 percent by weight of the coal can be converted to liquid hydrocarbons, with yield and composition of the liquid products depending, inter alia, on the origin and composition of the coal.

The liquid hydrocarbons obtained in the process according to the present invention include primarily paraffin hydrocarbons and a fluctuating quantity of aromatic hydrocarbons. The proportion of aromatics is greater in the fractions having the higher boiling point than in the fractions having the lower boiling point. The aromatics content depends on the origin of the coal, the composition of the coal, and the particular reaction conditions used to carry out the process according to the present invention.

In the practice of the present invention, the comminuted coal is treated with water at a temperature of 380° to 600° C. and a pressure of 260 to 450 bar. Inasmuch as water has a critical temperature of $T_k$=374.2° C. and a critical pressure of $P_k$=to 221.3 bar, the water is in its supercritical state during the treatment of the coal. Surprisingly, it has been found that treating the coal with water in the supercritical state positively influences the yield of liquid hydrocarbons. In spite of the high temperatures and pressures employed, the process according to the present invention is economical, safe and, in particular, nonpolluting. The economical and nonpolluting operation of the process of the present invention is based mainly on the facts that (1) the coal residue, developed after the water treatment, is very well suited for gasification because of its high porosity or for generating energy, and (2) the water can easily be separated from the liquid hydrocarbons. Moreover, the water prevents caking together of the bulk coal which enhances a uniform reaction process.

The process according to the present invention can be performed to particular advantage by employing comminuted coal which has a particle size of 1$\mu$ to 5 mm, by treating the coal with a quantity of water of 100 to 1000 percent by weight with respect to the coal, and by employing a quantity of hydrogen of 2 to 10 percent by weight with respect to the coal for the hydrogenation.

In the present invention where there is a simultaneous water treatment and hydrogenation, and the catalyst is dissolved in the supercritical water, it is preferred to employ the catalyst in a quantity of 0.001 to 0.5 weight percent, with respect to the water. In this variation of the process, it has been found to be particularly advantageous to use NaOH, KOH, $Na_4SiO_4$, $KBO_2$ or $NaBO_2$ as the catalyst. Since the catalyst is dissolved in the aqueous phase, it is present in the reaction system in a very homogeneous distribution and therefore has a particularly great effect.

The process according to the present invention preferably is practiced in such a manner that the water treatment and the hydrogenation take place in 10 to 120 minutes.

The components which are in the gas phase can be separated therefrom by a number of techniques in which the hydrogenated gas phase is subjected to at least one separation by reduction of pressure and temperature. The hydrogenated gas phase which is subjected to the separation is that which has been separated from the comminuted coal. The gas phase contains inorganic components, including ash components which are present in the coal and some of which dissolve in the gas phase, and catalyst components. Preferably, these inorganic components are separated first from the gas phase.

In one embodiment of the present invention for separating the inorganic components, the hydrogenated gas phase, is subjected to a pressure reduction to 230 250 bar, to thereby precipitate the inorganic compounds contained in the gas phase in solid form. The precipitated inorganic compounds preferably are separated from the gas phase in a cyclone or filter. By following this embodiment of the present invention, the inorganic compounds dissolved in the gas phase, which are the ash components of the coal and the catalyst, are separated from the gas phase in solid form so that the subsequent separation of the reaction mixture is facilitated considerably.

In order to separate the ash-free hydrogenated reaction mixture into fractions it has been found particularly advantageous to first remove a heavy oil fraction from the gas phase by reducing the pressure and temperature of the gas phase to 140 to 160 bar and 350° C., then remove a medium oil fraction from the gas phase by lowering its pressure and temperature to 2 to 10 bar and 150° to 200° C., and finally, separate a water/raw gasoline fraction from the gas phase by lowering its pressure and its temperature to 1 bar and 25° C. The separated water/raw gasoline fraction preferably can then be separated into its components by decanting, and the water can be reused for treating the coal. By separating the gas phase in the manner just described, three fractions of liquid hydrocarbons are obtained in an advantageous manner, each of which can then be further separated or processed further separately.

In another embodiment of the present invention for separating the inorganic components, the hydrogenated gas phase is subjected to a treatment wherein the pressure of the gas phase is reduced to 200 to 220 bar and its temperature is reduced to 360° to 370° C. to thereby precipitate the solid inorganic compounds and water from the gas phase. The solid inorganic compounds and water are separated together from the gas phase in the form of a solution or suspension, respectively according to their solubility. This embodiment of the process of the present invention is possible because under the stated conditions, the inorganic compounds, which are ash components and the dissolved catalyst, as well as the water are precipitated out of the gas phase. According to this embodiment, only some of the water which is present in the hydrogenated gas phase is circulated through the remainder of the separation process. Although a portion, aproximately 10% by weight, has been removed with the inorganic components, this embodiment preferably is accomplished in the following manner: The ash-free, water-free hydrogenated gas phase is expanded to a pressure of 20 to 55 bar and separated in a rectification column into a heavy oil fraction, a medium oil fraction and a raw gasoline fraction by employing a temperature of 360° to 370° C. at the head of the column and a temperature of 210° to 335° C. at the sump. As a result of the position of the high pressure phase equilibrium, raw gasoline is obtained as the head product and heavy oil as the sump product of the rectification column. The medium oil fraction is removed from the rectification column as a side stream.

In accordance with a further embodiment, the heavy oil fraction is mixed, completely or in part, with the comminuted coal so that the higher boiling point hydrocarbons and the major portion of the aromatic hydrocarbons are circulated. With this mode, the yield of lower boiling point hydrocarbons and paraffin hydrocarbons is increased. Moreover, by employing this mixture the comminuted coal can be stored and transported with a minimum of dust development. It is also possible to use such a pumpable coal/heavy oil mixture as the raw material in the process of the present invention.

The economy of the present invention can be improved by using the gases which remain after the separation of the solid inorganic compounds, the liquid hydrocarbons, and the water from the gas phase. These remaining gases preferably are freed from $H_2S$ and/or $NH_3$ and then burned for the generation of energy.

The successful practice of the present invention is based on the following properties: Water in the supercritical state almost quantitatively dissolves the extractable organic compounds present in the coal due to its low viscosity, surface tension and penetration into the micropores of the coal. Under the high operating temperature, the high molecular hydrocarbons are cracked to low boiling point hydrocarbons. The catalysts accelerate this cracking. The unsaturated aliphatic hydrocarbons present in the supercritical water vapor phase are almost quantitatively converted into alkanes or cycloalkanes during the catalytic hydrogenation. The aromatics existing in the supercritical water vapor phase are partially hydrogenated so that their proportion in the products is comparatively low, with the heavy oil fraction containing the largest proportion of aromatics. The sulfur and nitrogen organic compounds present in the coal are cracked to produce hydrocarbons as well as $H_2S$ and $NH_3$. The catalysts present in the process are contaminated only insignificantly by the sulfur and nitrogen compounds present.

Turning now to the drawings, there is shown a flow chart for the process according to the present invention.

As shown in the FIGURE, coal is conveyed from reservoir bunker 1 into mill 2 where it is comminuted to a grain size of about 0.2 to 1 mm. During the grinding process, the coal is mixed with water which enters into mill 2 through line 3 to form a coal/water suspension. In mixer 4, the coal/water suspension is mixed with heavy oil coming through line 5. A catalyst is conducted into mixer 4 from a reservoir vessel 49.

The coal/water/oil/catalyst mixture passes through conduit 6 and pressure pump 7 into the heated high pressure reactor 8. Before entering the high pressure reactor 8, heated hydrogen in measured quantities is added to this mixture through line 50.

Extraction processes, as well as cracking and hydrogenation reactions, take place in high pressure reactor 8 at a pressure of 350 to 380 bar and at a temperature of 450° to 550° C., during a reaction period of about 40 minutes under the influence of the catalyst. In high pressure reactor 8, a charged hydrogenated supercritical water vapor gas phase containing organic compounds and a coal residue forms.

The coal residue is removed from high pressure reactor 8 through a line 51, while the supercritical water vapor phase charged with the organic compounds leaves high pressure reactor 8 through a line 52. The supercritical water vapor phase is expanded in an expansion valve 53 to a pressure of about 210 bar and is cooled in a heat exchanger 54 to a temperature of 360° C. Under these conditions, the inorganic compounds dissolved in the supercritical gas phase as well as the water are precipitated in a separator 55. Both the inorganic compounds and water components are extracted from separator 55 through a line 56 either as a suspension or a solution, and fed into a filter 74.

From separator 55, the gaseous phase travels through a line 57 into an expansion valve 58 where its pressure is reduced to about 40 bar. The gas phase is then conducted through a line 59 into a heated rectification column 60 at whose head the temperature is 360° C. and in whose center portion the temperature is 280° C., while in its sump the temperature is 210° C. The gas phase which contains a raw gasoline fraction is removed from the head of the rectification column 60 through a line 61, a medium oil fraction is removed from the center portion through a line 62 and a heavy oil fraction is removed from the sump through a line 63.

The heavy oil fraction is sent from line 63 into an expansion vessel 64 where the heavy oil fraction is expanded and gases are released. The released gases are conducted through a line 76 into line 61. After cooling, the heavy oil fraction is conducted into a tank 65. Similarly, the medium oil fraction is sent from line 62 into an expansion vessel 66 where the medium oil fraction is expanded and gases are released. The released gases are conducted into line 61.

After cooling, the medium oil fraction is conducted into a tank 67. The gas phase travels from line 61 into an expansion valve 68 and into a heat exchanger 69 where its pressure and temperature are reduced to the values existing in the environment. The gas phase is then passed into a separator 70 where a raw gasoline fraction is separated and discharged into a tank 71 through a line 72. The remaining water collects at the bottom of tank 71 and is discontinuously extracted through a line 73. The gas leaving separator 70 comprises $H_2$,CO, $CO_2$, as well as a hydrocarbon fraction ($C_1$ to $C_4$), and is contaminated with $NH_3$ and/or $H_2S$. This gas is conveyed into a gas purification device 34, where $H_2S$ and/or $NH_3$ are separated.Then, the purified gas is combusted in a boiler system 35 where energy is generated. All or part of the heavy oil fraction is conducted from tank 65 through line 5 to mixer 4. The medium oil fraction and the raw gasoline fraction are processed further according to known distillation methods.

The coal residue travels from reactor 8 through line 51 into reactor 41 where it is gasified with air and water. The gas produced in reactor 41 is fed wholly or in part to the conversion system 42 and is there processed into hydrogen which after separation of the $CO_2$ in pressure washer 46, is fed to tank 43 through line 44. That part of the gas which is not processed into hydrogen may be used to generate energy by burning it in boiler system 35.

In filter 74, the solids are filtered out of the aqueous suspension coming from line 56 and are deposited in a deposit together with the ashes developed in reactor 41. The filtrate coming out of filter 74 is conducted through a line 75 into a water purification system.

It will be understood that the above description of the present invention is susceptible to various modifications, changes and adaptations, and the same are intended to be comprehended within the meaning and range of equivalents of the appended claims.

What is claimed is:

1. A process for producing liquid hydrocarbons from coal, comprising:

treating comminuted coal which has a particle size of 1$\mu$ to 5 mm with water at 380° to 600° C. and 260 to 450 bar for 10 to 120 minutes in an amount of from 100 to 1000 percent by weight with respect to the coal and simultaneously with the treatment with the water, adding hydrogen and providing a catalyst to form a charged hydrogenated supercritical gas phase containing hydrogenated organic compounds and a coal residue, the hydrogen being present in an amount of 2 to 10 percent by weight with respect to the coal, the catalyst being selected from the group consisting of NaOH, KOH, $Na_4SiO_4$, $KBO_2$ and $NaBO_2$ and being dissolved in water in a quantity of from 0.001 to 0.5 weight percent with respect to the water; and separating the hydrogenated gas phase into its components in a plurality of fractions by lowering its pressure and temperature.

2. Process as defined in claim 1, and further comprising generating energy from the coal residue.

3. Process as defined in claim 1, and further comprising generating gas from the coal residue.

4. Process as defined in claim 1, wherein the hydrogenated supercritical gas phase is separated from the comminuted coal, and the separated hydrogenated supercritical gas phase is subjected to a pressure reduction to reduce its pressure to 230 to 250 bar to precipitate from the gas phase inorganic compounds in solid form.

5. Process as defined to in claim 4, wherein the precipitated inorganic compounds are separated from the gas phase in a cyclone or filter.

6. Process as defined in claim 4 wherein the gas phase, freed from the solid inorganic compounds, is subjected to successive fractionations comprising lowering the pressure and the temperature of the gas phase to 140 to 160 bar and 350° C. to remove a heavy oil fraction, then lowering the pressure and the temperature of the gas phase to 2 to 10 bar and 150° to 200° C. to remove a medium oil fraction, and then lowering the pressure and the temperature of the gas phase to 1 bar and 25° C. to remove a water/raw gasoline fraction.

7. Process as defined in claim 6, wherein the heavy oil fraction is mixed, wholly or in part, with comminuted coal.

8. Process as defined in claim 6, wherein the water/-raw gasoline fraction is separated by decanting, and the separated water is reused for treating the coal.

9. Process as defined in claim 6, wherein the gas phase remaining after the successive fractionations is freed from $H_2S$ and/or $NH_3$, and then combusted for the generation of energy.

10. Process as defined in claim 1, wherein the hydrogenated supercritical gas phase is separated from the comminuted coal, and the separated hydrogenated supercritical gas phase is subjected to a pressure reduction to 200 to 220 bar and a temperature reduction to 360° to 370° C. to precipitate out solid inorganic compounds and water from the gas phase.

11. Process as defined in claim 10, wherein the precipitated solid inorganic compounds and water are separated from the gas phase as a suspension.

12. Process as defined in claim 10, wherein the precipitated solid organic compounds and water are separated from the gas phase as a solution.

13. Process according to claim 10 wherein the gas phase, freed from the solid inorganic compounds and water, is expanded to a pressure to 20 to 55 bar, and thereafter is divided in a rectification column at a head temperature of 360° to 370° C. and a sump temperature of 210° to 335° C. into a heavy oil fraction, a medium oil fraction and a raw gasoline fraction.

14. Process as defined in claim 13, wherein the heavy oil fraction is mixed, wholly or in part, with the comminuted coal.

15. Process as defined in claim 13 wherein the gas phase remaining after the separation of the solid inorganic compounds, the water and the fractions, is initially freed from $H_2S$ and/or $NH_3$, and then combusted for the generation of energy.

* * * * *

UNITED STATES PATENT AND TRADEMARK OFFICE

CERTIFICATE OF CORRECTION

PATENT NO. : 4,485,003

DATED : November 27, 1984

INVENTOR(S) : Hubert Coenen et al

It is certified that error appears in the above-identified patent and that said Letters Patent is hereby corrected as shown below:

The title page should be deleted to appear as per attached title page.

Title page, in the ABSTRACT, line 8, change "$NaBO_4$, or $KOB_2$" to --$NaBO_2$ or $KBO_2$--.

Delete the sheet of Drawing containing Figure 1.

Figure 2:
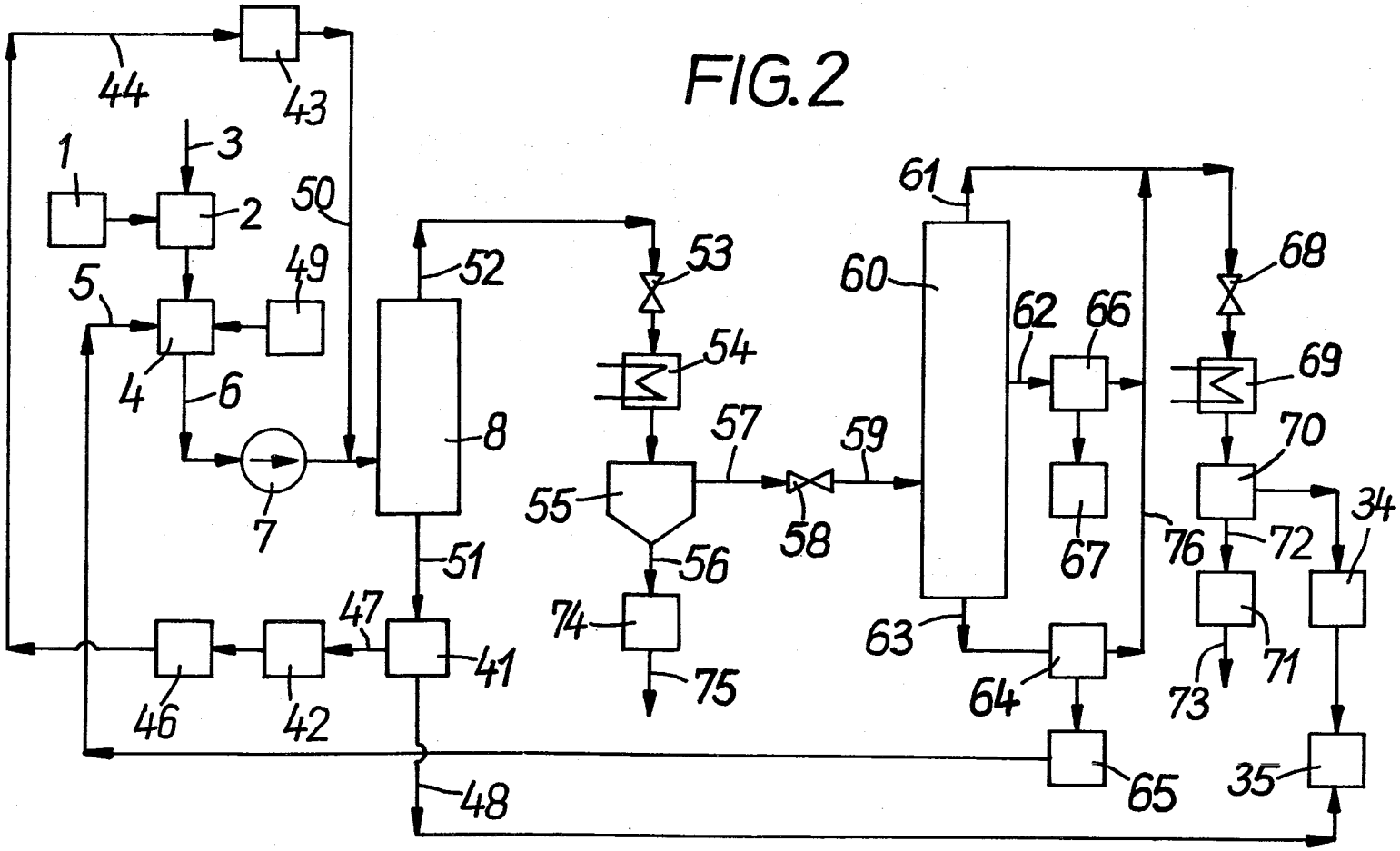

From the sheet presently containing the figure labeled "Fig.2", delete the legend --Fig.2--.

Column 3, line 35, insert --to-- between "230" and "250".

Signed and Sealed this

*Twenty-eighth* Day of *May 1985*

[SEAL]

*Attest:*

DONALD J. QUIGG

*Attesting Officer* *Acting Commissioner of Patents and Trademarks*

United States Patent [19]

Coenen et al.

[11] Patent Number: 4,485,003

[45] Date of Patent: Nov. 27, 1984

[54] SUPERCRITICAL EXTRACTION AND SIMULTANEOUS CATALYTIC HYDROGENATION OF COAL

[75] Inventors: Hubert Coenen; Rainer Hagen; Ernst Kriegel, all of Essen, Fed. Rep. of Germany

[73] Assignee: Fried. Krupp Gesellschaft mit beschränkter Haftung, Essen, Fed. Rep. of Germany

[21] Appl. No.: 402,933

[22] Filed: Jul. 29, 1982

[30] Foreign Application Priority Data

Aug. 25, 1981 [DE] Fed. Rep. of Germany ..... 3133562

[51] Int. Cl.[3] ..... C10G 1/06

[52] U.S. Cl. ..... 208/10; 208/8 LE

[58] Field of Search ..... 208/8 R, 10, 8 LE

[56] References Cited

U.S. PATENT DOCUMENTS

| | | | |
|---|---|---|---|
| 3,488,280 | 1/1970 | Schulman | 208/10 |
| 3,505,204 | 4/1970 | Hoffman | 208/10 |
| 3,660,269 | 5/1972 | McCauley | 208/8 |
| 3,745,108 | 7/1973 | Schuman | 208/10 |
| 3,850,738 | 11/1974 | Stewart, Jr. et al. | 208/8 R |
| 4,019,975 | 4/1977 | Uruqhart | 208/10 |
| 4,056,460 | 11/1977 | Malek | 208/8 LE |
| 4,222,849 | 9/1980 | Shimizu | 208/8 LE |
| 4,237,101 | 12/1980 | Willard, Sr. | 208/8 LE |
| 4,298,450 | 11/1981 | Ross et al. | 208/10 |
| 4,338,184 | 7/1982 | Maa et al. | 208/8 LE |

*Primary Examiner*—Delbert E. Gantz
*Assistant Examiner*—Lance Johnson
*Attorney, Agent, or Firm*—Spencer & Frank

[57] ABSTRACT

A process for producing liquid hydrocarbons from coal comprises treating comminuted coal at 380° to 600° C. and 260 to 450 bar with water in a high pressure reactor to form a charged supercritical gas phase and a coal residue. Simultaneously with the water treatment, hydrogenation with hydrogen takes place in the presence of a catalyst. The catalyst is selected from the group consisting of NaOH, KOH, $Na_4SiO_4$, $NaBO_4$, or $KOB_2$. Then, the gas phase is divided into several fractions by lowering its pressure and temperature. Energy and/or gas is generated from the coal residue.

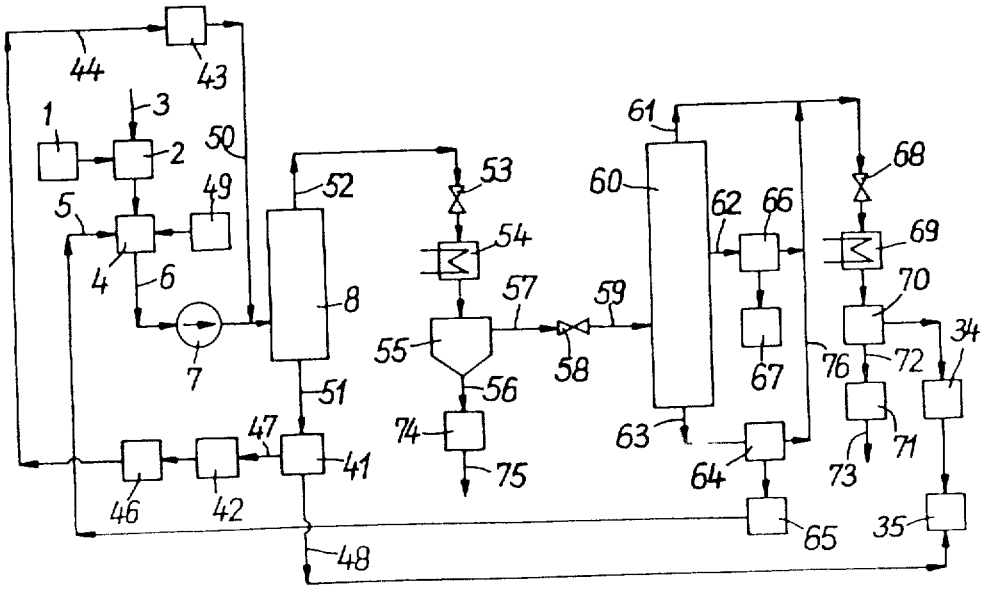

15 Claims, 1 Drawing Figure